US006847283B2

(12) United States Patent
Schirmer

(10) Patent No.: US 6,847,283 B2
(45) Date of Patent: Jan. 25, 2005

(54) INDUCTIVE TRANSLATOR COMPOSED OF TWO SPOOLS WITH RESPECTIVE CORES

(75) Inventor: Juergen Schirmer, Heidelberg (DE)

(73) Assignee: Robert Bosch GbmH, Stuttgart (DE)

( * ) Notice: Subject to any disclaimer, the term of this patent is extended or adjusted under 35 U.S.C. 154(b) by 94 days.

(21) Appl. No.: 10/276,142

(22) PCT Filed: Mar. 21, 2001

(86) PCT No.: PCT/DE01/01075

§ 371 (c)(1),
(2), (4) Date: Nov. 12, 2002

(87) PCT Pub. No.: WO01/88931

PCT Pub. Date: Nov. 22, 2001

(65) Prior Publication Data

US 2003/0117250 A1 Jun. 26, 2003

(30) Foreign Application Priority Data

May 13, 2000 (DE) ..... 100 23 592

(51) Int. Cl.[7] ..... H01F 21/06; H01F 27/04
(52) U.S. Cl. ..... 336/212; 336/210; 336/134
(58) Field of Search ..... 336/83, 210, 212, 336/178, 130–131, 132, 134, 220, 221, 115, 117–118; 320/108, 109

(56) References Cited

U.S. PATENT DOCUMENTS 3,810,136 A * 5/1974 Lang et al. ..... 341/6
5,598,134 A * 1/1997 Ito ..... 336/83
5,850,134 A * 12/1998 Oh et al. ..... 320/106
5,917,307 A * 6/1999 Watanabe et al. ..... 320/108
6,291,969 B1 * 9/2001 Kaneko ..... 320/108
6,489,874 B2 * 12/2002 Katsura et al. ..... 336/130
6,703,734 B2 * 3/2004 Hakamata et al. ..... 310/90
2003/0117250 A1 * 6/2003 Schirmer ..... 336/131

FOREIGN PATENT DOCUMENTS

DE 21 17 611 A 10/1972
EP 0 357 829 A 3/1990
EP 0 926 690 A 6/1999

* cited by examiner

*Primary Examiner*—Anh Mai
(74) *Attorney, Agent, or Firm*—Michael J. Striker

(57) ABSTRACT

The invention concerns an inductive transmitter comprising two coils (1, 2), each with one core (3, 4). The two cores (3, 4) are capable of being moved relative to each other. Two systems are integrated in the transmitter that make it possible to simultaneously transmit data and/or energy, as well as the position of the two cores (3, 4) relative to each other. Finally, the transmission of data and/or energy takes place by means of induction, and the determination of the position of the two cores (3, 4) relative to each other takes place via a measurement of the magnetic field that exists between the two coils (1, 2).

13 Claims, 1 Drawing Sheet

INDUCTIVE TRANSLATOR COMPOSED OF TWO SPOOLS WITH RESPECTIVE CORES

BACKGROUND OF THE INVENTION

The invention concerns an inductive transmitter comprising two coils, each with one core.

Such inductive transmitters are used to transmit data and/or energy between two parts that move in relation to each other, e.g., in the form of rotational transmitters, to transmit data and/or energy in rotating parts (e.g., steering wheels in motor vehicles), or in the form of linear transmitters in the case of parts that move linearly in relation to each other. The transmitters comprise two coils, each with one core, whereby the two cores are capable of being moved in relation to each other. The transmission of data and/or energy takes place by means of induction (transformer principle).

It is further known that the relative position of two parts capable of being moved in relation to each other can be determined using magnetic measurement methods.

If data and/or energy is to be transmitted, or if the position of two parts relative to each other is to be determined, the procedure so far was to use two separate systems, one of which served to transmit the data and/or the energy, and the other of which served to determine the relative position. This resulted in a need for more space, a large number of components, and high costs.

SUMMARY OF THE INVENTION

In contrast, the inductive transmitter according to the invention having the features of claim 1 has the advantage that the transmitter is very small and compact. Since two separate systems having different functions are integrated in a single system, the number of individual parts is reduced. This results in cost savings while retaining the same functionality.

Advantageous further developments of the inductive transmitter indicated in claim 1 are made possible by the features listed in the dependent claims.

BRIEF DESCRIPTION OF THE DRAWINGS

Two exemplary embodiments of the invention are presented in the drawings and they are described in greater detail in the subsequent description.

DETAILED DESCRIPTION OF THE PREFERRED EMBODIMENTS

Figure 1:
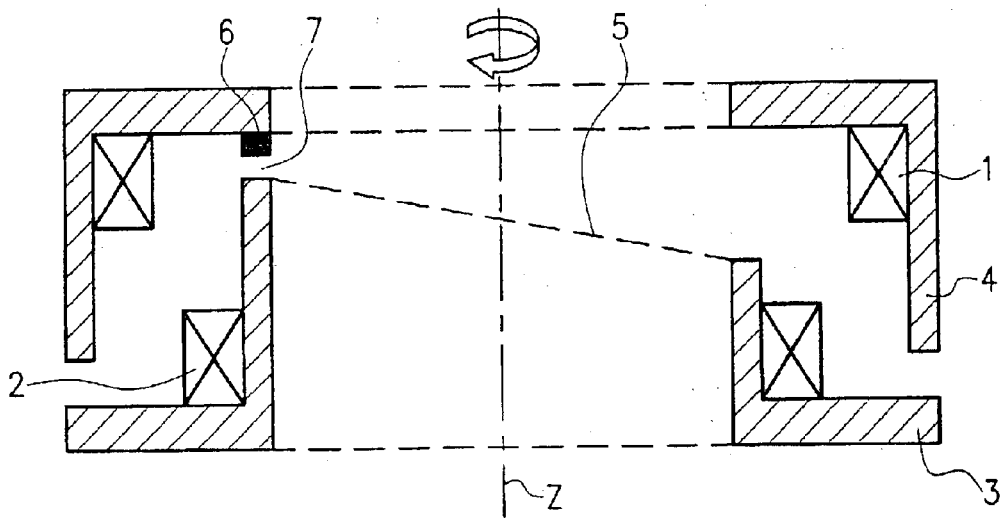
FIG. 1 shows a sectional drawing through an inductive transmitter in the form of a rotational transmitter.

A first exemplary embodiment of the invention is shown in FIG. 1. In this exemplary embodiment, the inductive transmitter is designed as a rotational transmitter. It comprises two coils 1, 2, each with one annular core 3, 4, one of which—core 3 in the exemplary embodiment—is supported in a fashion that allows it to rotate around an axis Z. The cross-section of the two cores 3, 4 can be designed in the shape of an "L". The arm of the "L" of core 3 facing core 4 is equipped with a contour 5, an incline in this case. A magnetic field-sensitive sensor 6 is located on the core 4 opposite to the incline, which said sensor can be designed as a Hall-effect sensor, a magnetoresistive sensor, or the like.

As a result of the contour 5 designed as an incline, the air gap 7 between the two cores 3 and 4 changes when core 3 rotates around the axis Z. This change in the air gap 7 causes a change in the magnetic flux that can be measured with the magnetic field-sensitive sensor 6. The measured magnetic flux is directly proportional to the angle of rotation between the two cores 3 and 4.

Using this embodiment, it is possible to not only transmit data and/or energy, it is also possible to determine the relative position of the two cores 3 and 4 in relation to each other.

Figure 2:
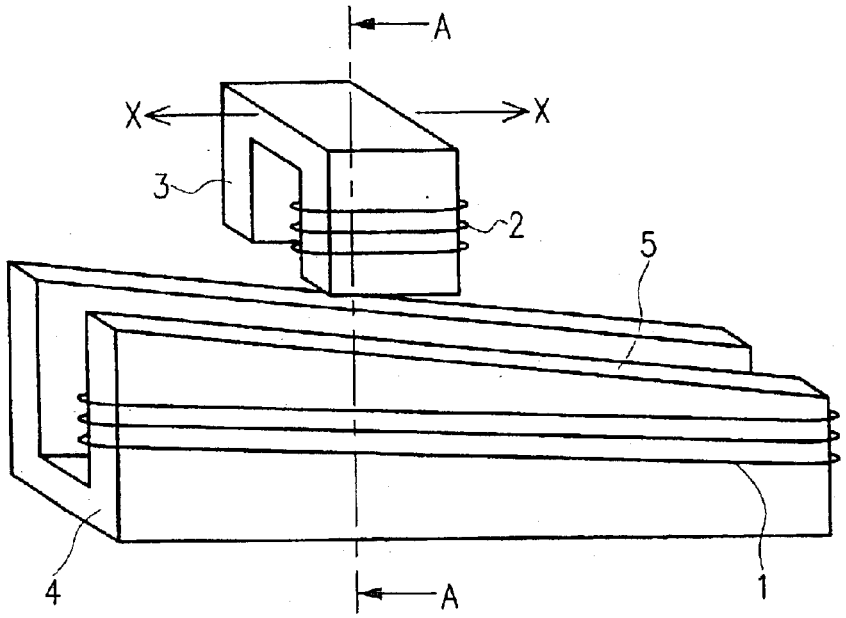
FIG. 2 shows a view of an inductive transmitter in the form of a linear transmitter.
Figure 3:
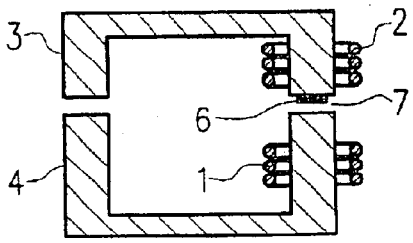
FIG. 3 shows a sectional drawing in the direction A—A according to FIG. 2.

FIGS. 2 and 3 show a further exemplary embodiment, in the case of which the inductive transmitter is designed as a linear transmitter. With such a linear transmitter, it is possible in the case of removable seats in motor vehicles, for example, to transmit signals from operator elements and side air bags, or energy for seat heating, or servomotors; additionally, the position of the seats can be measured in vehicles with automatic seat adjustment.

The linear transmitter according to FIGS. 2 and 3 functions according to the same principle as the rotational transmitter according to FIG. 1. Two coils 1, 2, each with one core 3, 4, are also provided, whereby the cross-sections of the two cores 3, 4 can be designed in the shape of a "U". They can also be designed in the shape of an "L", however. The coil 2 with its core 3 is capable of being moved in the direction of the arrow X in FIG. 2. On its side facing core 3, core 4 is equipped with a contour 5 that is formed as an incline, as in the exemplary embodiment according to FIG. 1. The incline is formed on at least one exposed arm of the "U". A sensor 6 is located on core 3 on the side opposite to the incline on at least one exposed arm of the "U". If both exposed arms of the "U" of core 4 are equipped with a contour 5, it is also possible to attach a sensor 6 to both exposed arms of the "U" of core 3.

When core 3 is moved in the direction of the arrow X in FIG. 2, the air gap 7 between the two cores 3 and 4 changes. This results in a change in the magnetic flux that can be measured by the sensor 6. The measured magnetic flux is directly proportional to the position of the two cores 3 and 4.

In both exemplary embodiments, only coil 1 in core 4 is current-carrying, while coil 2 in core 3 is not current-carrying, and its sole purpose is induction with coil 1 in core 3.

The preceding description of the exemplary embodiments according to the present invention is intended for illustrative purposes only and not for purposes of limiting the invention. Various changes and modifications are possible within the framework of the invention without leaving the scope of the invention or its equivalents.

What is claimed is:

1. An inductive transmitter, comprising:

two coils, each coil having one core, wherein the two cores are moveable relative to one another, wherein the transmitter enables data and/or power to be simultaneously transmitted and determines a position of the two cores relative to one another, wherein the data and/or power is transmitted by means of induction produced between one of the two coils and one of the two cores;

a sensor, wherein the sensor is sensitive to magnetic fields, and wherein the position of the two cores in relation to one another is determined by measuring the magnetic field prevailing between the two coils with the sensor.

2. The inductive transmitter according to claim 1, wherein the sensor is in the form of a Hall sensor, magnetoresistive sensor or the like.

3. The inductive transmitter according to claim 1, wherein the sensor is arranged in an air gap between the two cores.

4. The inductive transmitter according to claim 1, wherein relative movement of the two cores in relation to one another is a rotary movement.

5. The inductive transmitter according to claim 1, wherein relative movement of the two cores in relation to one another is a linear movement.

6. The inductive transmitter according to claim 1, wherein at least one of the cores is provided with a contour, wherein said contour brings about a change in a magnetic flux in the sensor.

7. The inductive transmitter according to claim 6, wherein the contour of a first one of the two cores faces a second one of the two cores.

8. The inductive transmitter according to claim 6, wherein the contour is designed as an incline.

9. The inductive transmitter according to claim 6, wherein the sensor and the contour are arranged opposite to one another.

10. The inductive transmitter according to claim 6, wherein the sensor is arranged on a first one of the two cores and the contour is arranged on a second one of the two cores.

11. The inductive transmitter according to claim 6, wherein the sensor and the contour are arranged on the same core.

12. The inductive transmitter of claim 6, wherein the cores are L-shaped in cross section and the contour is formed on one limb of the L.

13. The inductive transmitter of claim 6, wherein the cores are U-shaped in cross section and the contour is formed on at least one free limb of the U.

* * * * *